US006467212B1

(12) United States Patent
Apel

(10) Patent No.: US 6,467,212 B1
(45) Date of Patent: Oct. 22, 2002

(54) UNIVERSAL RECOIL PAD SYSTEM AND METHOD OF INSTALLATION

(76) Inventor: Dietrich Apel, 438 Willow Brook Rd., Plainfield, NH (US) 03781

( * ) Notice: Subject to any disclaimer, the term of this patent is extended or adjusted under 35 U.S.C. 154(b) by 0 days.

(21) Appl. No.: 09/519,296

(22) Filed: Mar. 6, 2000

Related U.S. Application Data

(60) Provisional application No. 60/123,437, filed on Mar. 9, 1999.

(51) Int. Cl.[7] ..... F41C 23/08; F41C 23/20
(52) U.S. Cl. ..... 42/74
(58) Field of Search ..... 42/71.01, 74

(56) References Cited

U.S. PATENT DOCUMENTS

| | | | | | |
|---|---|---|---|---|---|
| 1,331,074 | A | * | 2/1920 | Marble | 42/74 |
| 1,349,779 | A | * | 8/1920 | Marble | 42/74 |
| 3,135,064 | A | * | 6/1964 | Pachmayr | 42/74 |
| 4,956,932 | A | | 9/1990 | Cupp | 42/74 |
| 5,001,855 | A | * | 3/1991 | Griggs | 42/74 |
| 5,235,765 | A | | 8/1993 | Chesnut | 42/74 |
| 5,471,776 | A | | 12/1995 | Chesnut et al. | 42/74 |

FOREIGN PATENT DOCUMENTS

| | | | | |
|---|---|---|---|---|
| IT | 529088 | * | 2/1955 | 42/74 |

OTHER PUBLICATIONS

Slip On Recoil Pads & Accessories, p. 16.
Brownell,Catalogue, 4 pages.
GummiFormteille GMBH, 2000, pp. 1–19.

* cited by examiner

*Primary Examiner*—Stephen M. Johnson
(74) *Attorney, Agent, or Firm*—Bourque & Associates, PA

(57) ABSTRACT

A universal recoil pad system allows different recoil pads having different styles, sizes and degrees of softness to be interchangeably attached to a gunstock. The universal recoil pad system includes a recoil pad having a cavity and a rigid frame molded within the pad. A pad attachment member is removably secured to the frame and within the cavity. A gunstock attachment member is attached to the end of the gunstock, for example, using conventional wood screws. The recoil pad is removably attached to the gunstock by slidably engaging the pad attachment member with the gunstock attachment member. A flat spring disposed within the pad attachment member holds the pad attachment member into engagement with the gunstock attachment member. The recoil pad can also include holes for securing the recoil pad to the gunstock using conventional methods.

25 Claims, 4 Drawing Sheets

UNIVERSAL RECOIL PAD SYSTEM AND METHOD OF INSTALLATION

RELATED APPLICATIONS

This application claims the benefit of U.S. Provisional Patent Application Serial No. 60/123,437 filed Mar. 9, 1999, now abandoned, fully incorporated herein by reference.

FIELD OF THE INVENTION

The present invention relates to recoil pads for use on gunstocks and more particularly, to a universal recoil pad system that allows recoil pads to easily and quickly be changed.

BACKGROUND OF THE INVENTION

A rifle or shotgun generates a recoil force when fired. Typically, the firearm is positioned against the shoulder of the shooter, and the recoil force is applied to the shoulder. To reduce the amount of force felt on the shoulder when the firearm is used, firearms utilize recoil pads attached to the back of the gunstock. Conventional recoil pads are primarily made of a resilient material, such as rubber. The resilient material is intended to absorb at least part of the generated recoil force so that the force applied to the shooter is reduced and more uniformly distributed.

Conventional recoil pads are attached to the gunstock using screws that mount the recoil pad directly to the gunstock. When the recoil pad is directly mounted to the gunstock using screws, however, the pad cannot easily be removed and replaced. Different guns and different shooting conditions often demand different styles of pads, pads having different thicknesses or lengths, and pads having different degrees of softness/hardness. Trap shooters, for example, typically use a different styled pad than hunters. Also, the stock length must be proper for accurate shooting. For example, shooting in cold weather with heavy clothing requires a shorter stock length. The stock length may also need to be altered when two individuals of different sizes (e.g., a father and son) are sharing a gun.

Some quick change recoil pads have been developed but suffer from some problems. Some quick change recoil pad systems require fastening mechanisms screwed between the pad and the stock, making installation difficult, time consuming and not amenable to an amateur. Other mechanisms used in quick change recoil pad systems must be integrated or installed directly into the stock itself. These mechanisms can only be used on specially manufactured stocks which were produced by the manufacturer with the built in fastening mechanism or with a suitable cavity for insertion of the mechanism by the user. Thus, the conventional quick change recoil pad system can only be used on certain specially-made gunstocks. Also, many of the existing quick change recoil pad systems do not allow the option of installing the recoil pad in the conventional manner using screws.

Accordingly, there is a need for a universal recoil pad system that allows recoil pads of different sizes and absorbability to be removably installed on gunstocks without requiring a specially-made gunstock and without requiring significant alteration to the gunstock. There is also a need for a universal recoil pad system that can be easily installed by a skilled amateur or a semi-skilled gunsmith and that can optionally be installed using the conventional method.

SUMMARY OF THE INVENTION

The present invention features a universal recoil pad system for removable attachment to an end of a gunstock.

The universal recoil pad system comprises a recoil pad having a cavity and including a rigid frame molded within the pad. A pad attachment member is received in the cavity and secured to the rigid frame such that the pad attachment member is recessed into the recoil pad. A gunstock attachment member is secured to the end of the gunstock. The pad attachment member slidably engages into attachment with the gunstock attachment member such that the recoil pad is removably attached to the gunstock.

The pad attachment member preferably includes at least two channels and openings at first and second ends. The gunstock attachment member preferably includes at least two attachment heads that extend through the respective openings and slidably engage the respective channels. The first and second attachment heads can be disposed on an attachment bar adapted to be secured to the gunstock, or can be disposed on first and second posts adapted to be screwed into the gunstock. The pad attachment member preferably includes a flat spring proximate at least one opening for biasing against the attachment head when the attachment head enters the opening and slidably engages the channel.

The present invention also features a recoil pad for use in a recoil pad system. The recoil pad includes an elastomeric body with faceplate having a cavity, a rigid frame molded within the elastomeric body, and a pad attachment member positioned within the cavity of the recoil pad and secured to the rigid frame. The pad attachment member includes at least one channel and opening for receiving and slidably engaging a gunstock attachment member attached to an end of a gunstock.

The recoil pad preferably includes pre-drilled holes through the elastomeric body for receiving screws to secure the recoil pad directly to the gunstock without the pad attachment member. The rigid frame molded within the elastomeric body preferably includes at least two internally threaded holes for receiving threaded fasteners to secure the pad attachment member to the rigid frame. The predrilled holes preferably are aligned with the internally threaded holes such that the screws can extend through the internally threaded holes and into the gunstock.

The present invention also features a method of installing a universal recoil pad system. The method comprises the steps of attaching a gunstock attachment member to a gunstock, inserting a pad attachment member into a cavity within a recoil pad, attaching the pad attachment member to a frame molded within the recoil pad, and sliding the pad attachment member into attachment with the gunstock attachment member. The method can also include the steps of disengaging the pad attachment member from the gunstock attachment member, detaching and removing the pad attachment member from the cavity within the recoil pad, inserting screws through the recoil pad, and securing the recoil pad directly to a gunstock using the screws.

DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENT

Figure 1:
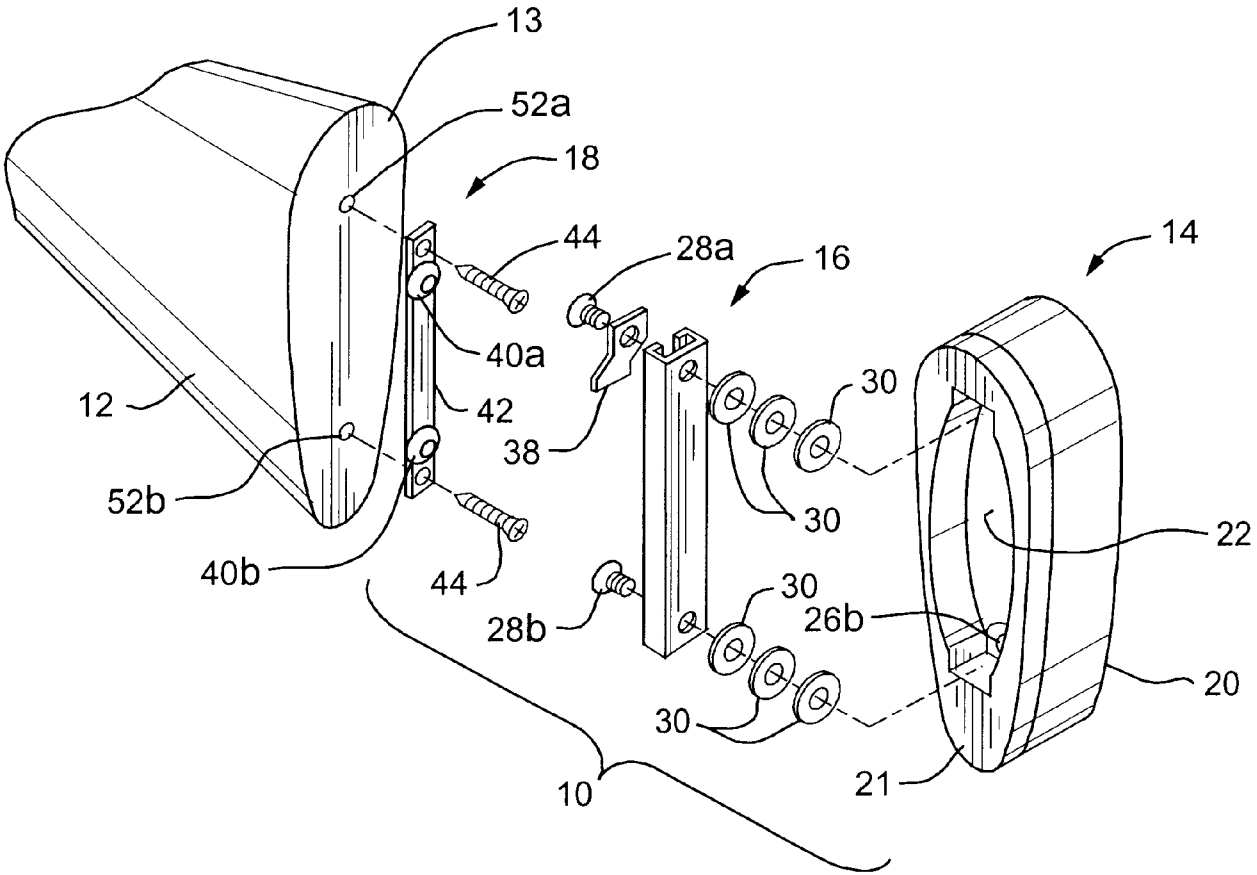
FIG. 1 is an exploded perspective view of a universal recoil pad system, according to one embodiment of the present invention.

A universal recoil pad system 10, FIG. 1, according to the present invention, can be removably attached to a gunstock 12 made of wood or a synthetic material. The recoil pad system 10 generally includes a recoil pad 14, a pad attachment member 16 to be secured within the recoil pad 14, and a gunstock attachment member 18 to be secured to the end 13 of the gunstock 12. The pad attachment member 16 slidably engages the gunstock attachment member 18 to effect a removable attachment between the recoil pad 14 and the gunstock 12, as will be described in greater detail below.

The recoil pad 14 includes an elastomeric body 20 secured to a rigid faceplate 21 that abuts the end 13 of the gunstock 12 when the recoil pad 14 is attached. The elastomeric body 20 can be made out of any elastomeric materials suitable for recoil pads. The faceplate 21 can be made of any suitable rigid material, such as hard rubber bonded to the elastomeric body 20 with rubber cement and heat cured in a mold. The elastomeric body 20 and faceplate 21 define a cavity 22 for receiving the pad attachment member 16 such that the pad attachment member 16 is recessed within the recoil pad 14.

Figure 3:
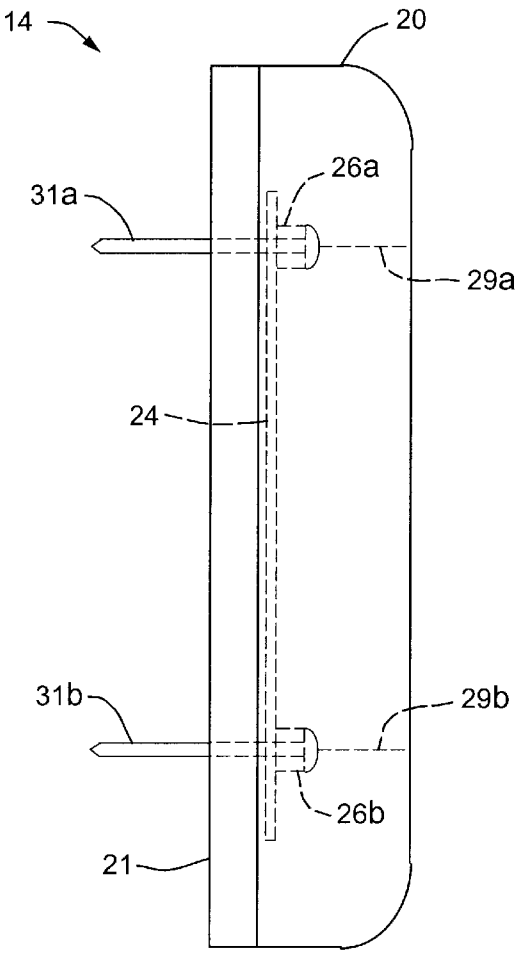
FIG. 3 is a side view of the recoil pad used in the universal recoil pad system, according to the present invention.
Figure 2:
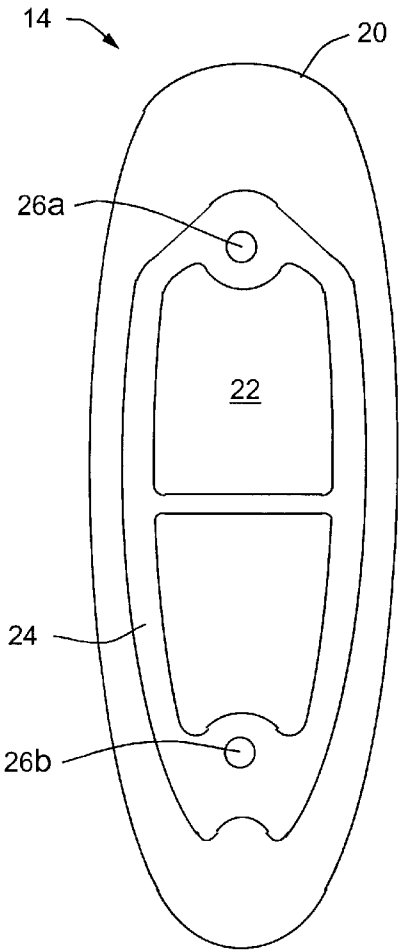
FIG. 2 is a rear view of the recoil pad used in the universal recoil pad system, according to the present invention.

A rigid frame 24, FIGS. 2 and 3, is preferably molded within the elastomeric body 20. The rigid frame 24 can be made of steel or other suitable rigid materials. In the exemplary embodiment, the rigid frame 24 includes internally threaded members 26*a*, 26*b* that receive threaded fasteners 28*a*, 28*b*, such as machine screws, which extend through the pad attachment member 16. The pad attachment member 16 is thereby removably secured to the rigid frame 24 and within the cavity 22 of the elastomeric pad 20. The pad attachment member 16 can also be secured to the recoil pad 14 using other techniques. One or more washers 30 or other similar elements can be disposed between the pad attachment member 16 and the rigid frame 24 to adjust the pad attachment member 16 as needed. In one example, each of the washers 30 is about 0.010 inches thick.

Figure 6:
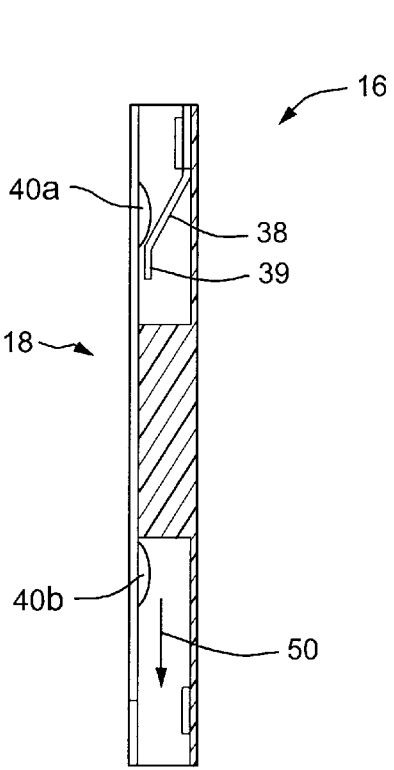
FIG. 6 is a cross-sectional view of the pad attachment member engaged with the gunstock attachment member, according to one embodiment of the present invention.
Figure 5:
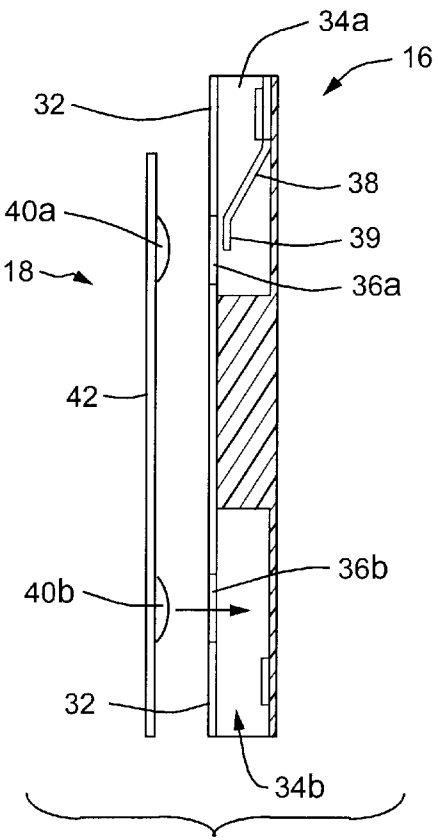
FIG. 5 is a cross-sectional view of the pad attachment member and gunstock attachment member, according to one embodiment of the present invention.
Figure 4:
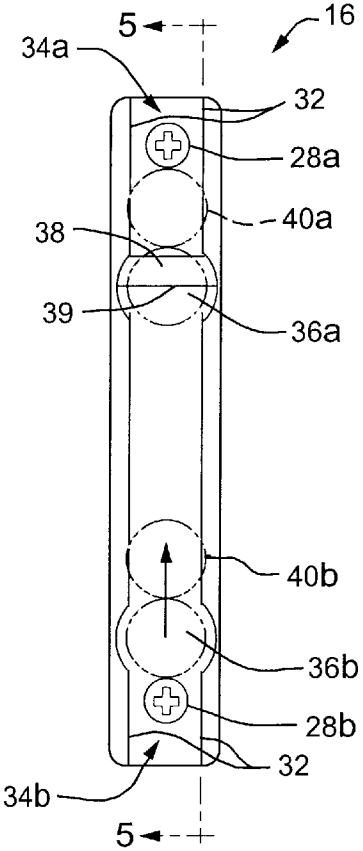
FIG. 4 is a front view of the pad attachment member used in the recoil pad, according to one embodiment of the present invention.

According to the exemplary embodiment, the pad attachment member 16, FIGS. 4–6, includes rails 32 defining first and second channels 34*a*, 34*b* at respective first and second ends of the pad attachment member 16. Respective openings 36*a*, 36*b* in the pad attachment member 16 correspond to and open to each of the channels 34*a*, 34*b*. The pad attachment member 16 is preferably made of a suitable rigid material, such as nylon reinforced with fiberglass. A flat spring 38 is disposed within at least one of the channels 34*a* and has one end 39 extending toward the respective opening 36*a*.

The gunstock attachment member 18 includes first and second attachment heads 40*a*, 40*b* corresponding to the first and second openings 36*a*, 36*b* and first and second channels 34*a*, 34*b*. The attachment heads 40*a*, 40*b* are preferably truss heads having a generally rounded shape. The openings 36*a*, 36*b* in the pad attachment member 16 are dimensioned to allow the attachment heads 40*a*, 40*b* to pass through the respective openings 36*a*, 36*b* and into the respective channels 34*a*, 34*b*. The channels 34*a*, 34*b* are dimensioned to allow the attachment heads 40*a*, 40*b* to slide while the rails 32 hold the attachment heads 40*a*, 40*b* in the respective channels 34*a*, 34*b*.

Figure 7:
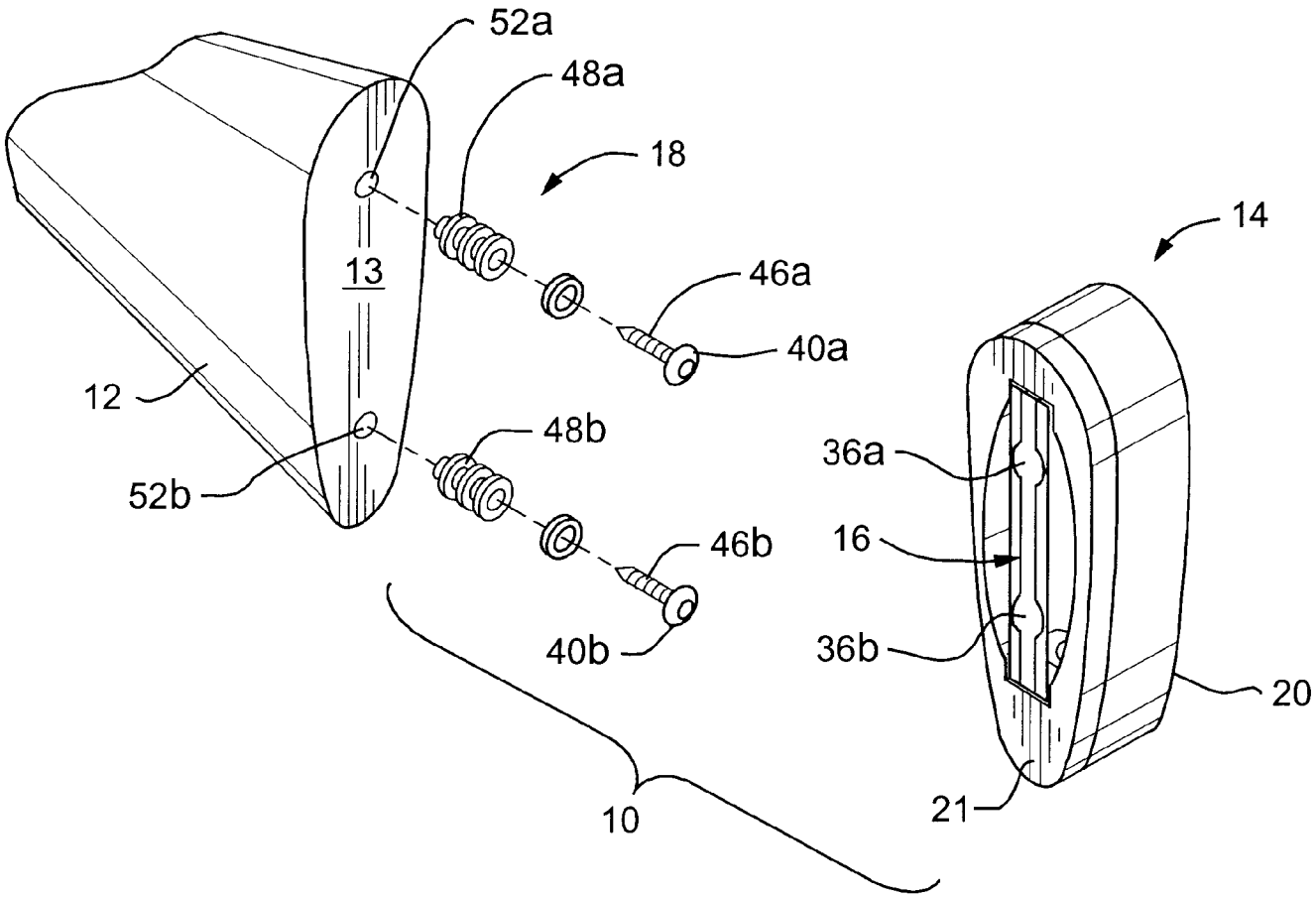
FIG. 7 is an exploded perspective view of a universal recoil pad system, according to another embodiment of the present invention.

In one embodiment, the attachment heads 40*a*, 40*b* are disposed on an attachment bar 42 which is secured to the end 13 of the gunstock 12, for example, using wood screws 44. In another embodiment, the attachment heads 40*a*, 40*b*, FIG. 7, are disposed on separate threaded fasteners 46*a*, 46*b* (e.g., truss head posts), which are threaded directly into the end 13 of the gunstock 12 or into anchors 48*a*, 48*b* screwed into the gunstock 12. Using the separate threaded fasteners 46*a*, 46*b* allows the gunstock 12 to be hollowed out for the through bolt which holds the stock to the action, for weight reduction and/or storage compartments.

To engage the pad attachment member 16 with the gunstock attachment member 18 (see FIGS. 5 and 6), the attachment heads 40*a*, 40*b* are aligned with and forced through the respective openings 36*a*, 36*b*. At least one of the attachment heads 40*a* is forced against the end 39 of the flat spring 38. When the attachment heads 40*a*, 40*b* have passed through the openings 36*a*, 36*b*, the pad attachment member 16 is then moved in the direction of arrow 50 causing the attachment heads 40*a*, 40*b* to slide beneath the rails 32 and within the respective channels 34*a*, 34*b*. The flat spring 38 is biased against the attachment head 40*a*, thereby locking the pad attachment member 16 into engagement with the gunstock attachment member 18. The mating of the pad attachment member 16 and gunstock attachment member 18 is such that the pad 14, when removed and reattached, returns to the same position without looseness.

Although the exemplary embodiment shows attachment heads, openings, and channels having a specific shape and configuration, other attachment mechanisms having different shapes and configurations can also be used to allow the pad attachment member 16 and gunstock attachment member 18 to slidably engage into attachment.

The recoil pad 14 (see FIG. 3) can also include holes 29 predrilled through or premolded in the elastomeric body 20. The holes 29*a*, 29*b* are aligned with the internally threaded members 26*a*, 26*b* such that conventional wood screws 31*a*, 31*b* can be inserted into the holes 29*a*, 29*b* and can pass through the internally threaded members 26*a*, 26*b* to secure the recoil pad 14 directly to the gunstock 12 according to the conventional method. According to this method, the pad attachment member 16 is not secured within the cavity 22 of the recoil pad 14.

To install the universal recoil pad system 10, the end 13 of the gunstock 12 must first be made flat and to the proper length or pitch, for example, by sanding. A transparent template (not shown) is used to mark one or more screw locations 52*a*, 52*b* (see FIGS. 1 and 7) for the gunstock attachment member 18. If the attachment bar 42 is used, only one of the screw locations 52*a*, 52*b* needs to be marked. The bar 42 is then screwed on and serves as a template for drilling the second hole. Where the gunstock attachment member 18 includes separate fasteners 46*a*, 46*b*, the template is used to mark both screw locations 52*a*, 52*b* and the fasteners 46*a*, 46*b* are screwed into the appropriate locations.

To install the pad attachment member 16, the flat spring 38 is inserted into the pad attachment member 16 and aligned with one of the holes. If needed, one or more (usually three) washers 30 are placed over the holes in the internally threaded members 26*a*, 26*b* within the cavity 22. According to one example of assembling the present invention, plastic pins (not shown) are first inserted into the holes in the threaded members 26*a*, 26*b*, and the washers 30 are placed over the plastic pins such that the plastic pins keep the washers 30 in place and aligned with the holes. The pad attachment member 16 is then inserted into the cavity 22 and the plastic pins extend through the holes in the attachment member 16. One plastic pin at a time is pulled before inserting the threaded fasteners 28*a*, 28*b* through the pad attachment member 16. The threaded fasteners 28*a*, 28*b* are threaded into the internally threaded members 26*a*, 26*b*. The recoil pad 14 is removably attached to the gunstock 12, as described above, by slidably engaging the pad attachment member 16 with the gunstock attachment member 18. If the pad fits too loosely, one or more washers 30 can be removed, or if the pad fits too tightly, washers 30 can be added. The underside of faceplate 21 can be flat sanded on a piece of sandpaper on a flat surface.

The recoil pad 14 may need to be modified to fit the size and shape of the gunstock 12. With the pad 14 snapped into the locked position, an outline of the gunstock 12 can be scribed onto the pad 14. The recoil pad 14 can then be modified by grinding the recoil pad 14 to fit the proper shape and size of the gunstock 12. Alternatively, manufacturers of guns and gunstocks can pre-grind pads to given dimensions on available equipment. The pre-ground pads can be created with a carbide likeness and attached with the system of the present invention to a pre-turned gunstock and then match sanded on a suitable sander.

To secure the recoil pad 14 using the conventional method, the pad attachment member 16 can be removed. Screws 31*a*, 31*b* (see FIG. 3), such as conventional wood screws, can then be inserted through the holes 29*a*, 29*b* and through the internally threaded members 26*a* and 26*b*. The screws 31*a*, 31*b* are screwed into the end 13 of the gunstock to attach the recoil pad 14 directly to the gunstock 12 in the conventional manner.

Using the universal recoil pad system 10, numerous different recoil pads 14 of different sizes, thicknesses, styles, colors and degrees of softness can be interchangeably attached to a single gunstock 12. Installation of the universal recoil pad system 10 of the present invention is no more difficult than traditional and conventional installation. The present invention requires no significant preparation or alteration of the gunstock 12 and does not require specially-designed gunstocks to be manufactured. The universal recoil pad system of the present invention can also be easily installed by a skilled amateur or semi-skilled gunsmith without danger of scratching the stock finish.

Modifications and substitutions by one of ordinary skill in the art are considered to be within the scope of the present invention which is not to be limited except by the claims which follow.

What is claimed is:

1. A universal recoil pad system for removable attachment to an end of a gunstock, said system comprising:

a recoil pad having a cavity, said recoil pad including a rigid frame molded within said recoil pad;

a pad attachment member adapted to be received in said cavity of said recoil pad and secured to said rigid frame such that said pad attachment member is recessed into said recoil pad when attached, said pad attachment member including at least two channels and openings at first and second ends of said pad attachment member; and a gunstock attachment member adapted to be secured to said end of said gunstock, wherein said pad attachment member includes at least two attachment heads that extend through respective said openings and slidably engage respective said channels such that said recoil pad is removably attached to said gunstock.

2. The universal recoil pad system of claim 1 wherein said pad attachment member further includes a flat spring for biasing against said gunstock attachment member.

3. The universal recoil pad system of claim 1 wherein said gunstock attachment member includes a bar having said first and second attachment heads proximate first and second ends of said bar.

4. A universal recoil pad system for attachment to an end of a gunstock, said system comprising:

a recoil pad having a cavity and including a rigid frame molded within said recoil pad, said rigid frame including at least two internally threaded holes;

a pad attachment member adapted to be positioned within said cavity of said recoil pad and secured to said rigid frame using at least two threaded fasteners adapted to be received in said at least two internally threaded holes, said pad attachment member including at least one channel and opening;

a gunstock attachment member adapted to be secured to the end of said gunstock, said gunstock attachment member having at least one attachment head adapted to pass through said opening and slidably engage said channel.

5. The universal recoil pad system of claim 4 wherein said at least channel includes at least two channel regions each having an opening.

6. The universal recoil pad system of claim 5 wherein said at least two channel regions are separate and distinct sections.

7. A recoil pad for use in a universal recoil pad system, said recoil pad including:

an elastomeric body having a cavity;

a rigid frame molded within said elastomeric body; and a pad attachment member positioned within said cavity of said recoil pad and secured to said rigid frame, said pad attachment member including at least one channel and opening, for receiving and slidably engaging a gunstock attachment member attached to an end of a gunstock, and a flat spring proximate said opening for biasing against said gunstock attachment member.

8. The recoil pad of claim 7 wherein said pad attachment member is removable, and wherein said elastomeric body further includes holes through said elastomeric body, for receiving screws to secure said recoil pad directly to said gunstock.

9. The recoil pad of claim 7 further including a rigid faceplate attached to one side of said elastomeric body for abutting said end of said gunstock.

10. The recoil pad of claim 7 wherein said at least one channel and opening includes first and second channels and openings.

11. A method of installing a universal recoil pad system, said method comprising the acts of:

attaching a gunstock attachment member to a gunstock;

inserting a pad attachment member into a cavity within a recoil pad;

attaching said pad attachment member to a frame molded within said recoil pad;

inserting a first attachment member located on said gunstock attachment member into a first opening and channel located on said pad attachment member; and inserting at least a second attachment member located on said gunstock attachment member into at least a second opening and channel located on said pad attachment member, wherein said pad attachment member and said gunstock attachment member are not visible once installed.

12. The method of claim 11 further including the acts of:

disengaging said pad attachment member from said gunstock attachment member;

detaching and removing said pad attachment member from said cavity within said recoil pad;

inserting screws through said recoil pad; and securing said recoil pad directly to said gunstock using said screws.

13. A universal recoil pad system for removable attachment to an end of a gunstock, said system comprising:

a recoil pad having a cavity, said recoil pad including a rigid frame molded within said recoil pad;

a pad attachment member received in said cavity and secured to said rigid frame such that said pad attachment member is recessed into said recoil pad, said pad attachment member including at least two channels and openings at first and second ends of said pad attachment member; and a gunstock attachment member adapted to be secured to said end of said gunstock, said gunstock attachment member including at least two attachment heads wherein said at least two attachment heads are adapted to extend through said openings of said pad attachment member and slidably engage with said channels of said pad attachment member.

14. A universal recoil pad system for removable attachment to an end of a gunstock, said system comprising:

a recoil pad having a cavity, said recoil pad including a rigid frame molded within said recoil pad;

a pad attachment member adapted to be received in said cavity of said recoil pad and secured to said rigid frame such that said pad attachment member is recessed into said recoil pad when attached, said pad attachment member including at least two channel regions an openings at first and second end of said pad attachment member; and a gunstock attachment member adapted to be secured to said end of said gunstock, wherein said pad attachment member includes at least two attachment heads that extend through respective said openings and slidably engage respective said channels such that said recoil pad is removably attached to said gunstock.

15. The universal recoil pad system of claim 14 wherein said at least two channel regions are separate and distinct sections.

16. A universal recoil pad system for attachment to an end of a gunstock, said system comprising:

a recoil pad having a cavity and including a rigid frame molded within said recoil pad;

a pad attachment member adapted to be positioned within said cavity of said recoil pad and secured to said rigid frame, said pad attachment member including a first and at least a second channel region proximate first and second ends of said pad attachment member, said first and said at least a second channel region each having at least one opening;

a gunstock attachment member adapted to be secured to the end of said gunstock, said gunstock attachment member having a first and at least a second attachment head adapted to pass through said first and second openings and slidably engage said first and second channels respectively.

17. The universal recoil pad system of claim 16 wherein said first and said at least a second channel regions are separate and distinct sections.

18. A universal recoil pad system for removable attachment to an end of a gunstock, said system comprising:

a recoil pad having a cavity, said recoil pad including a rigid frame molded within said recoil pad;

a pad attachment member received in said cavity and secured to said rigid frame such that said pad attachment member is recessed into said recoil pad, said pad attachment member including at least two channel regions and openings at first and second ends of said pad attachment member; and a gunstock attachment member adapted to be secured to said end of said gunstock, said gunstock attachment member including at least two attachment heads wherein said at least two attachment heads are adapted to extend through said openings of said pad attachment member and slidably engage with said channels of said pad attachment member.

19. The universal recoil pad system of claim wherein said at least a two channel regions are separate and distinct sections.

20. A universal recoil pad system for attachment to an end of a gunstock, said system comprising:

a recoil pad having a cavity and including a rigid frame molded within said recoil pad;

a pad attachment member adapted to be positioned within said cavity of said recoil pad and secured to said rigid frame, said pad attachment member including at least one channel and opening and a flat spring proximate said opening;

a gunstock attachment member adapted to be secured to the end of said gunstock, said gunstock attachment member having at least one attachment head adapted to pass through said opening and slidably engage said channel wherein said flat spring biasas against said attachment head when said attachment head enters said opening and slidably engages said channel.

21. The universal recoil pad system of claim 20 herein said at least channel includes at least two channel regions each having an opening.

22. The universal recoil pad system of claim 21 wherein said at least two channel regions are separate and distinct sections.

23. A universal recoil pad system for attachment to an end of a gunstock, said system comprising:

a recoil pad having a cavity and including a rigid frame molded within said recoil pad;

a pad attachment member adapted to be positioned within said cavity of said recoil pad and secured to said rigid frame, said pad attachment member including a first and at least a second channel and opening proximate first and second ends of said pad attachment member;

a gunstock attachment member adapted to be secured to the end of said gunstock, said gunstock attachment member having a first and at least a second attachment head adapted to pass through said first and second openings and slidably engage said first and second channels respectively.

24. The universal recoil pad system of claim 23 wherein said first and second attachment heads are disposed on an attachment bar adapted to be secured to said gunstock with screws.

25. The universal recoil pad system of claim 23 wherein said first and second attachment heads are disposed on first and second posts adapted to be screwed into said gunstock.

* * * * *